US005497658A

United States Patent [19]

Fletcher et al.

[11] Patent Number: 5,497,658

[45] Date of Patent: Mar. 12, 1996

[54] METHOD FOR FRACTURING A FORMATION TO CONTROL SAND PRODUCTION

[75] Inventors: Paul A. Fletcher, Richardson; Carl T. Montgomery, Plano; Gangerico G. Ramos, Allen, all of Tex.

[73] Assignee: Atlantic Richfield Company, Los Angeles, Calif.

[21] Appl. No.: 218,007

[22] Filed: Mar. 25, 1994

[51] Int. Cl.[6] ..... E21B 49/00; E21B 43/26

[52] U.S. Cl. ..... 73/151; 166/250.01; 166/308

[58] Field of Search ..... 73/151, 155; 166/308, 166/250, 280, 279

[56] References Cited

U.S. PATENT DOCUMENTS

| | | | |
|---|---|---|---|
| 4,442,710 | 4/1984 | Meng | 73/155 X |
| 4,828,028 | 5/1989 | Soliman | 166/250 |
| 5,005,643 | 4/1991 | Soliman et al. | 73/155 X |
| 5,183,109 | 2/1993 | Poulsen | 73/155 X |
| 5,275,041 | 1/1994 | Poulsen | 73/155 |
| 5,318,123 | 6/1994 | Venditto et al. | 166/250 |
| 5,360,066 | 11/1994 | Venditto et al. | 166/250 |

*Primary Examiner*—Hezron E. Williams
*Assistant Examiner*—Michael J. Brock
*Attorney, Agent, or Firm*—F. Lindsey Scott

[57] ABSTRACT

A method for determining the minimum length for a fracture in a fluid-producing formation to control the production of sand therefrom wherein a plurality of critical drawdown pressures are calculated from known formation data which correspond to a plurality of different, estimated respective fracture lengths. Once the critical drawdown pressures for the reservoir are correlated with their corresponding fracture lengths, a critical drawdown curve for that particular reservoir is established. Additional sets of curves are generated from known data which when overlaid with the critical drawdown pressure curve allows a minimum length of fracture to be selected which will produce the formation at a given rate at a prescribed drawdown pressure without producing any substantial amounts of sand from the formation.

7 Claims, 5 Drawing Sheets

METHOD FOR FRACTURING A FORMATION TO CONTROL SAND PRODUCTION

DESCRIPTION

1. Technical Field

The present invention relates to a method for fracturing a subterranean production formation to control sand production and in one of its aspects relates to a method for establishing fractures having prescribed lengths into a subterranean formation which allow the formation to be produced at proper drawdown pressures below those which cause the production of sand from the formation.

2. Background Art

In producing hydrocarbons from unconsolidated or weakly-consolidated reservoirs, the production of particulates (e.g. sand) along with the hydrocarbons (e.g. oil and/or gas) has long been a problem. One of the most commonly used techniques for controlling this sand production is to "gravel pack" the production wells adjacent the producing formation. A typical "gravel pack" completion is one where a screen is set in the wellbore adjacent the production formation and is surrounded by "gravel" which filters out the sand as the produced fluids flow through the screen and into the production tubing.

However, installing a proper gravel pack in a particular well can be difficult and very expensive. Further, even the most sophisticated gravel packs often reduce the productivity of a well by increasing the "completion skin" (i.e. damage to the near-wellbore formation caused by drilling and/or completion). Several other techniques are known for controlling the production of sand but, as shown by the following comparison table, all of these common completion techniques adversely affect the production index (PI) of a well by increasing the damage to the formation near the wellbore:

| Completion Technique | Range of Skins | PI Range |
|---|---|---|
| 1. Perforated | −0.5 to 10 | 6.5 to 2 |
| 2. Resin Sand Consolidation | 6 to 22 | 3 to 1 |
| 3. External Gravel Packs | 8 to 33 | 2 to 0.7 |
| 4. Internal Gravel Packs | 15 to over 40 | 1.5 to 0.5 |

As can be seen from above, even the best internal gravel-packed wells experience high skins when compared to perforated non-gravel pack wells.

To reduce damage (skins) and improve productivity, techniques commonly referred to as "sand oil squeezes" have been used in completing a well. In such techniques, relatively large volumes of sand (i.e. proppants) are pumped into the formation at above fracture gradient pressures, see "Gravel Packing in Venezuela", R.E. Liebach et al, Seventh World Pet. Cong., Mexico City, Mexico, Sec. III, pgs 407–418. These operations which effectively combine a fracturing operation with a gravel pack are now called "frac and pack"; see "A Field Study of a Combination Fracuring/Gravel Packing Completion Technique", R.R. Hannah et al, SPE 26562, Houston, Tex., Oct. 3–6, 1993 and "Design, Execution and Evaluation of Frac and Pack Treatments", G.K. Wong et al, SPE 26563, Houston, Tex., Oct. 3–6, 1993.

Recently, "frac and pack" completions have been proposed not only for improving the productivity of a well but also for use as a sand control technique; see "Frac-Pack: An Innovative Stimulation and Sand Control Technique", B.W. Hainey et al, SPE 23777, Layette, La. Feb. 26–27, 1992. Sand control is accomplished by reducing the pressure drop across the perforations in the well casing. The completions, which have been used in the North Sea, recognize that propped fractures can allow the pressure drop across a perforation to be controlled to prevent the production of sand from the fractured formation but do not equate a particular fracture length to the critical drawdown pressure for that well; see "Propped Fracturing as a Tool for Sand Control and Reservoir Management", A. Bale et al, SPE 24992, 1993; SPE Production and Facilities, Feb., 1994, pps. 19–28.

SUMMARY OF THE INVENTION

The present invention provides a method for determining the minimum length for a fracture in a fluid-producing formation to control the production of sand therefrom. Basically, the method comprising measuring the strength of said formation and the fluid properties of the formation fluids from core samples, wellbore logs, and the like. Next, a plurality of critical drawdown pressures are calculated from the measured strength and fluid properties which correspond to a plurality of different, estimated respective fracture lengths, when formed in said formation.

Once the critical drawdown pressures for the reservoir are correlated with their corresponding fracture lengths, a critical drawdown curve for that particular reservoir is established. Additional sets of curves are generated from the known data and petroleum engineering relationships which when overlaid with the critical drawdown pressure curve allows a minimum length of fracture to be selected which will produce the formation at a prescribed drawdown pressure without producing any substantial amounts of sand from the formation.

One set of these additional curves represents calculated production flowrates as a function of drawdown pressures and fracture lengths at a constant fracture conductivity while another set of curves represents different fracture conductivities as a function of drawdown pressures and fracture lengths at a constant production flowrate.

By being able to select a minimun length for a fracture prior to the fracturing operation, the cost in completing a particular formation can be substantially reduced. That is, rather than randomly creating a fracture having a length longer than needed for sand control, a fracture having a shorter but still adequate length for sand control can be generated in the same formation in less time and for substantially less money which, in today's market, is an important consideration.

BRIEF DESCRIPTION OF THE DRAWINGS

The actual construction, operation, and apparent advantages of the present invention will be better understood by referring to the drawings in which like numerals identify like parts and in which.

BEST KNOWN MODE FOR CARRYING OUT THE INVENTION

Figure 1:
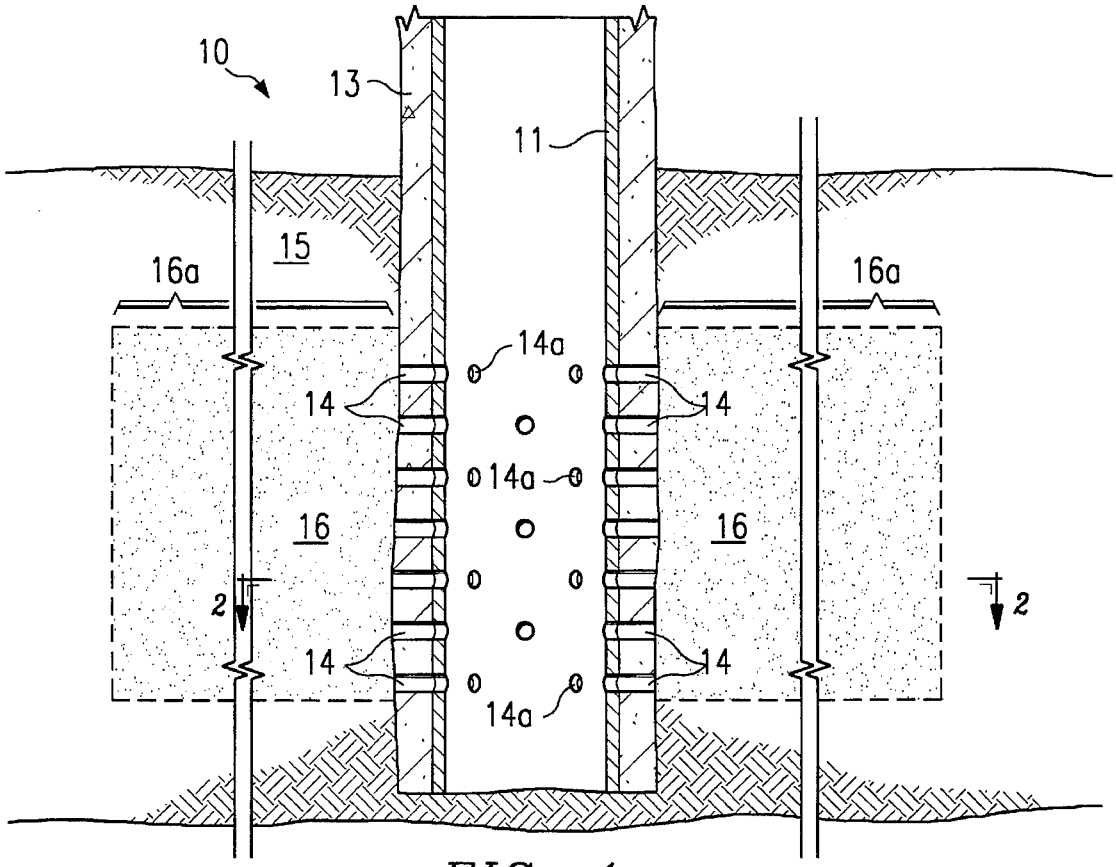
FIG. 1 is an elevational view, partly in section, of the lower end of a wellbore which has been hydraulically-fractured in accordance with the present invention.
Figure 2:
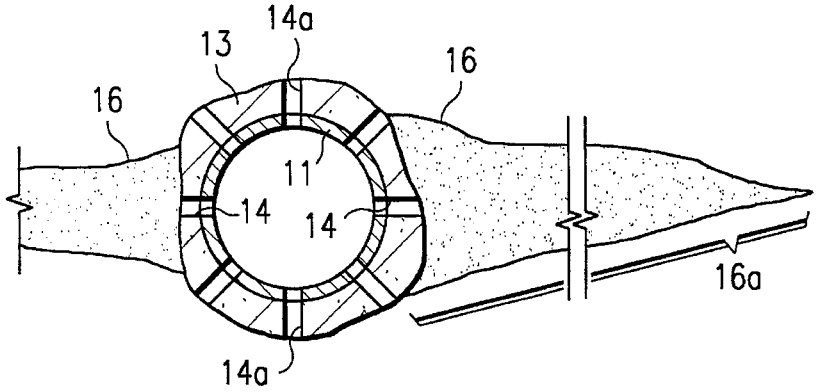
FIG. 2 is a sectional view taken along line 2—2 of FIG. 1.

Referring now to the drawings, FIG. 1 illustrates a well 10 which is completed into a subterranean, hydrocarbon-producing formation 15. The wellbore of well 10 has a casing 11 cemented in place and both casing 11 and cement 13 have been perforated with perforations 14 to provide fluid communication between formation 15 and the wellbore. Formation 15 has been hydraulically-fractured in accordance with the present invention as will be fully explained below.

As will recognized by those skilled in this art, when a formation is fractured, a fracturing fluid is pumped down the well and into the formation under high pressure thereby forming a vertically-extending fracture 16 which extends outward from the substantially diametrically-opposed perforations 14 which lie adjacent the natural fracture plane of the formation. Fractures will not occur adjacent those perforations 14*a* which do not lie on the fracture plane. The actual length 16*a* (i.e. the distance into the formation from wellbore) to which the fracture is extended into the formation is controlled by the actual fracturing operation, e.g. utimate volume of fracturing fluid used, injection pressures, etc., as will be understood by those skilled in the art. As is common in fracturing operation of this type, the fracturing fluid is laden with specifically-sized proppant or props (e.g. sand, ceramic beads, etc.) which are carried into and deposited in the fracture to hold the fracture open after the pressure is released to thereby establish a conductive flowpath from the formation into the wellbore.

Figure 3:
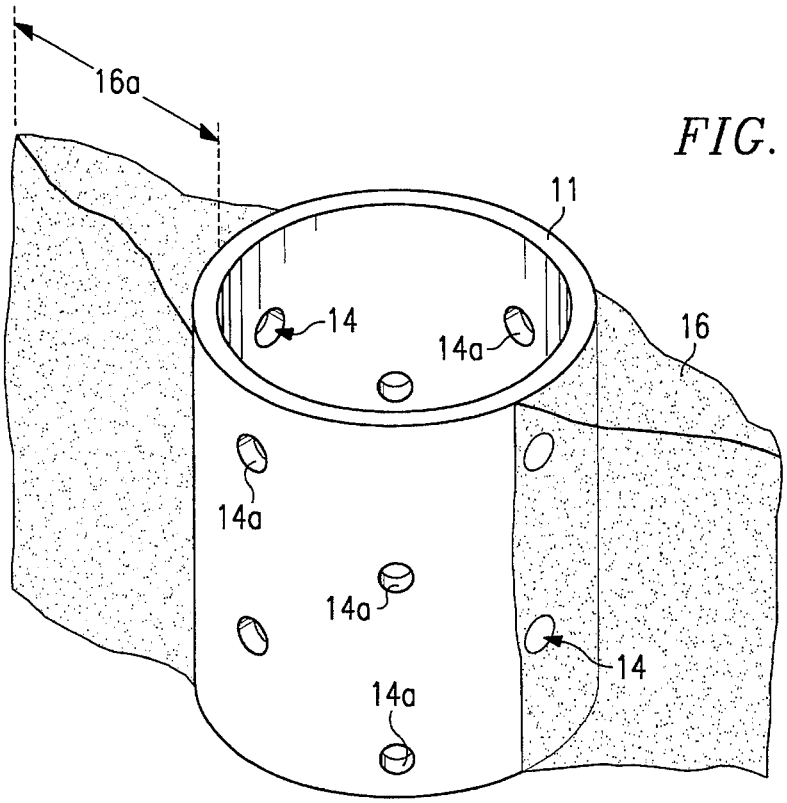
FIG. 3 is a perspective view illustrating a propped fracture in relation to in-phase and out-of-phase perforations in the casing of FIG. 1.

When evaluating hydraulic fracturing as an effective sand control method, the first step is to investigate whether or not the formation in question is likely to produce sand under commercial flowrates. As known, sand in the formation at the fracture face gets confined and strengthened by the packed proppant placed during the fracturing operation. Out-of-phase perforations 14*a* (i.e. those away from and undisturbed by the two-wing hydraulic fracture 16) remain as cavities from which sand can be produced and simply accumulate debris with no benefit of being propped (see FIG. 3). Unlike the propped fracture 16, there is no closure pressure in the perforation to solidify any proppant therein, leaving perforations 14*a* bare and unconfined. Thus, the weak links in a hydraulic-fracture completion such as described above, when used for sand control, are the unpacked perforations 14*a*.

This is true since, although the reservoir pressure gradient is diverted into the fracture 16 and away from the wellbore, substantial flow remains near the wellbore and coverges into any remaining perforations, e.g. 14*a*. Therefore, whether the formation is hydraulically stimulated or not, the integrity of a particular perforation dictates the early potential for sand production. Accordingly, it is neccessary to establish the relationships between the fracture, perforation, rock strength, and fluid pressure gradient in order to predict when this is likely to occur. This requires the coupling of two analyses; the hydraulic fracture effects on the flowing pressure gradient and the failure potential of the unpacked perforation tunnel ( i.e. adjacent perforation 14*a*).

Formation sand is produced when the combined effects of fluid drag and near-wellbore stresses cause disaggregation near the perforation. Individual grains of sand are detached from the matrix forming the formation after which bridging occurs wherein a stable sand-arch is formed at the perforation tip. This zone or arch is a dilated region with enhanced permeability and porosity but impaired strength; see "Stability and Failure of Spherical Cavities in Unconsolidated Sand and Weakly Consolidated Rock", T.K. Perkins et al, SPE 18244, Houston, Tex., Oct. 2–5, 1988.

At relativiely low flow rates, fluid drag does not affect arch stability, but as flow rate increases, drag forces become sufficiently high to remove sand particles from the arch, thereby de-stabilizing any sand bridges. If such drag forces are too high, no sand arches are formed and sand production continues.

Flowrate from a formation is normally controlled by the perforation drawdown pressure (dP) which is the difference between bottomhole pressure ($P_a$) and the pore pressure ($P_w$) in the formation and can be expressed as:

$$dP=P_w-P_a \quad (1)$$

wherein $P_w$ is the pore pressure at the vicinity of the perforation within 2 to 3 feet from the wellbore and is perpendicular to the fracture plane.

Relative to the perforation (e.g. 1" diameter perf), $P_w$ is the far-field pressure boundary condition, since the perforation is insensitive to pore pressure beyond a distance equal to approximately 3 times the diameter of the wellbore. This pressure is a function of the fracture length. Critical drawdown pressure (CDP) is the value of dP at which the sand arches begin to de-stabilize.

There are several methods for predicting when sand production will occur in a particular well, for example the methods disclosed and discussed in (1) "Stability and Failure of Sand Arches", R.K. Brati, SPE Journal, Apr., 1991, ppl 236–248; (2) "Perforation Cavity Stability", J. Tronvoll, SPE 24799, Washington, D.C., 1992; and (3) "Stability and Failure of Spherical Cavitiies in Unconsolidated Sand and Weakly Consolidated Rock", SPE 18244 (infra) (hereinafter referred to as "Perkins et al").

The preferred method for use in predicting the dP at which sand will be produced in the present invention is the one which is fully disclosed and explained in "Prediction of Sand Production in Gas Wells: Methods and Gulf of Mexico Case Studies", J.S. Weingarten et al, SPE 24797, Washington, D.C., Oct. 4–7, 1992 (hereinafter referred to as "Weingarten et al"). This method is an analytical method which has been successfully applied in oil wells and in gas wells. The typical information required for this method are a log analysis, including sonic and density logs, gas properties (temperature, pressure, and gravity) , and reservoir area, thickness, and depth. Using this information, a synthetic shear velocity log is generated, rock strengths are estimated from correlations, and in-situ stresses are estimated from the properties of the rock. A complete set of data would include, in addition, a dipole sonic log, confined compression and tension tests on a core sample, and fracture gradients. The more data, the better the correlations.

Figure 4:
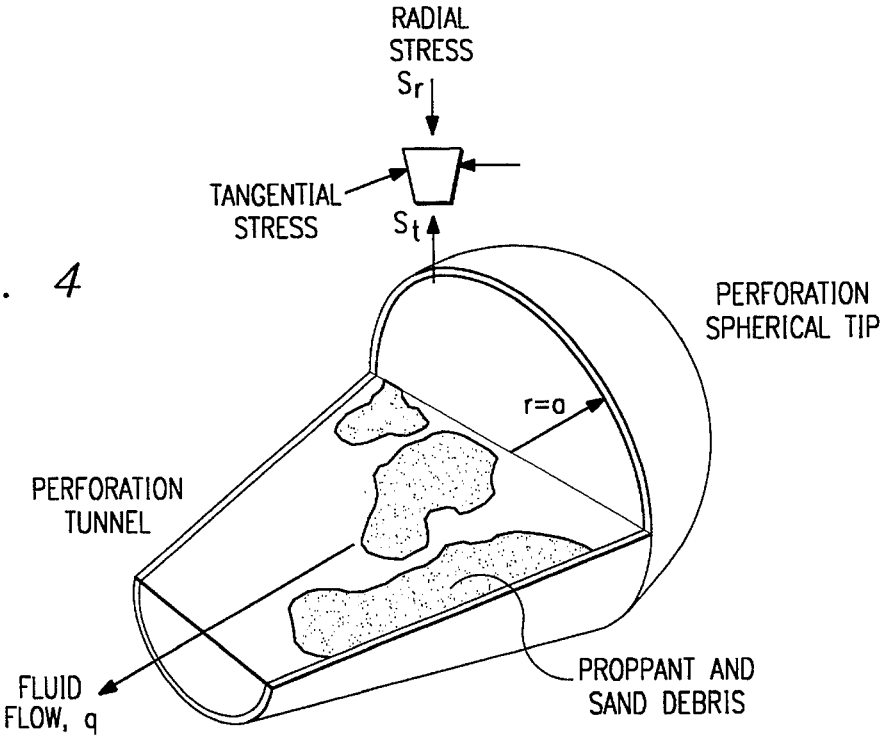
FIG. 4 is a perspective view of a model representing the idealized geometry of and flow through a perforation of FIG. 3.

The major factors considered in predicting sand-free production are fluid flow, fluid phase, geometrical constraints, and rock strength. First, the perforation is considered as a cylindrical cavity with a spherical end. Since flow at at the spherical end is more severe, the analysis uses flow gradient into a hemisphere where the steady-state pressure distribution follows Darcy's law (Equation 1 below) . For a representative model, see FIG. 4.

$$\frac{dp}{dr} = \frac{q\mu}{4\pi k r^2} \tag{2}$$

where:

p=pressure q=flow

μ=viscosity k=permeability r=radius of perforation (See FIG. 4)

For a spherical cavity, the governing stress relation for mechanical stability can be represented as follows:

$$\frac{dS_r}{dr} - \frac{2(S_r - S_t)}{r} = 0 \tag{3}$$

where:

$S_r$=radial stress $S_t$=tangential stress.

The Mohr-Coulomb theory of failure is applied (see Fundamentals of Rock Mechanics, Chapman and Hall Ltd., 1971, pp.85–91, 160-164:

$$\tau = C - \sigma_n \tan\alpha \tag{4}$$

where at the plane of failure

τ=the shear stress at failure $\sigma_n$=normal stress

C=the initial shear or cohesive strength

α=the angle of internal friction

For the mechanical integrity of the spherical tip of the perforation tunnel (FIG. 4) and for a perfectly-plastic rock that fails according to the Mohr-Coulomb failure theory:

$$S_r - S_t = \left(\frac{2\sin\alpha}{1-\sin\alpha}\right)(S_r - p + C\cot\alpha) \tag{5}$$

For weak formations that have zero tensile strength, the equation relating strength to fluid flow into a spherical cavity is:

$$\frac{q\mu}{4\pi k r} = \frac{C_d(1+3\sin\alpha_d)}{\tan\alpha_d(1-3\sin\alpha_d)} \tag{6}$$

where the subscript "d"=dilated spherical region.

Upon solving this equation,:

$$\frac{q\mu}{4\pi k r} = 4\,S_d \tan\beta \tag{6a}$$

where β=π/4+α/2

For a non-ideal gas, Weingarten et al show that imminent failure of the spherical cavity is given by:

$$\frac{4\sin\alpha}{1-\sin\alpha} - \left(\frac{P'_w - P'_a}{m+1}\right)\left(p'_w{}^{\left(\frac{-m}{m+1}\right)}\right) = 0 \tag{7}$$

where $$P'_a = \left[\frac{p_a \tan\alpha}{C}\right]^{(m+1)}$$

$$P'_w = \left[\frac{p_w \tan\alpha}{C}\right]^{(m+1)}$$

Where, for a non-ideal gas, "m" (gas density exponent) relates gas gravity ρ to density γ and pressure:

$$\rho = \gamma_o p^m \tag{8}$$

Figure 5:
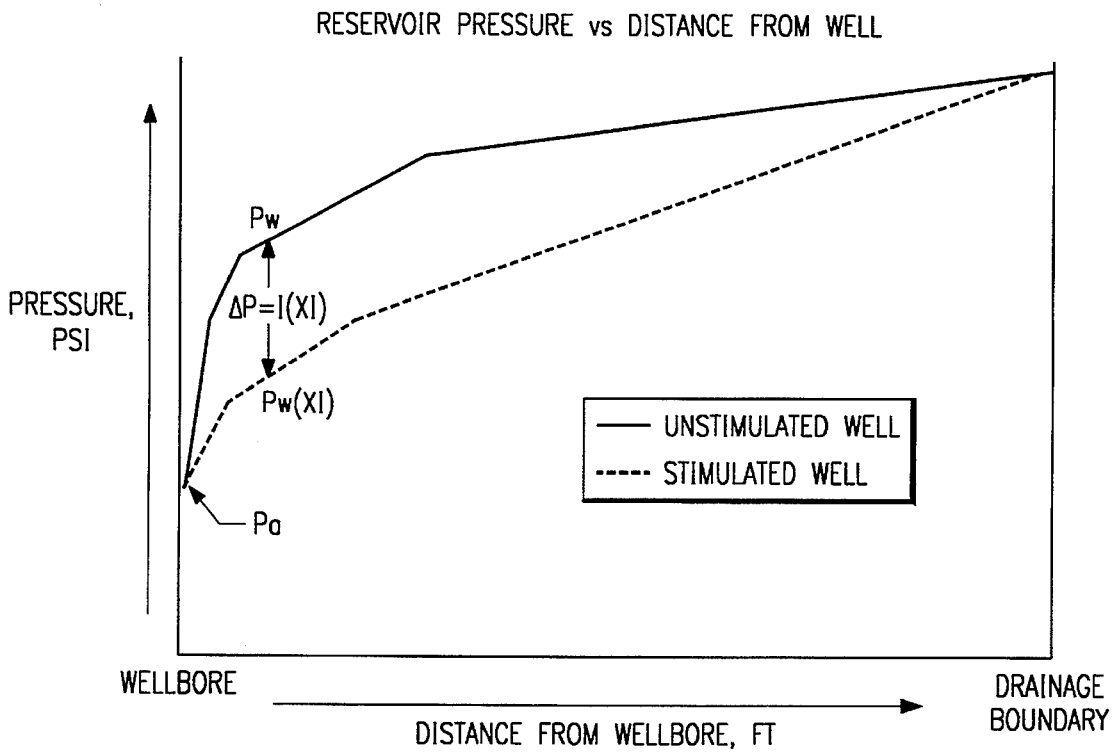
FIG. 5 is a graph plotting reservoir pressure versus distance from the wellbore comparing a stimulated (fractured) well and an unstimulated (unfractured) well.

Note that for a gas well, since density depends on pressure, then CDP decreases with reservoir pressure. Thus, for Equations 6 and 7, the required input for evaluating perforation CDP are fluid pressure, rock properties k, C and "a" (cavity radius, see FIG. 4), and fluid properties. For a given flow rate (i.e. production rate), the total allowable, sand-free drawdown pressure (TDP) for a perforation is:

$$TDP = dP_w + \Delta p(X_f) \tag{9}$$

where $\Delta p(X_f) = P_{inf} - P_w(X_f)$ where $P_{inf}$ is the far-field reservoir pressure (at infinity); $dP_w$ is the perforation critical drawdown pressure using $P_w$ which, in turn, is the near-perforation reservoir pressure. For a given fluid rate, $P_w$ is a function of fracture half length ($X_f$). The pressure difference ($\Delta p(X_f)$) quantifies the effect of the fracture on pore pressure near the perforation. Without the fracture, $\Delta p(X_f)$ is zero and with a 2-wing hydraulic fracture, $\Delta p(X_f)$ is a function of frac half length as shown in FIG. 5. Therefore, $\Delta p(X_f)$ is the additional allowable drawdown contributed by the hydraulic fracture.

Based on the above relationships, the main steps of the present method are as follows:

(1) Determine the strength of the formation, C, and β, using core strength data or calibrated logs of the well.

(2) Predict CDP before fracturing.

(3) Calculate $P_w(X_f)$ for a given frac length and flow rate.

(4) Calculate CDP with fracture, $P_w = f(X_f)$.

(5) Generate $X_f$ versus drawdown curves for the design rates at various conductivities of the fracture.

(6) Overlay results of Steps 4 and 5.

In the above step (1), it is preferred to obtain rock strength from core samples or sidewall plugs. Otherwise, sonic logs can be processed and calibrated to existing core data bases. In the Example which is set forth later herein, the empirical method of estimating strength was used (see Weingarten et al). Recently-introduced dipole sonic logs which are now available are preferred because they measure dynamic modulus which are correlated to static strength.

In step (2), the CDP calculation is straight-forward for oil reservoirs but requires a numerical method for the case of a gas well. In step (3), calculating reservoir pressure $P_w$ at the vicinity of the perforation is more efficiently determined from a reservoir simulators which are known in the art. It is preferred to use a simulator which, in turn, uses a fine grid near the well because the effect of the hydraulic fracture on the pressure gradient near the surviving perforation has to be calculated. Thus, an elliptical coordinate system is preferred over one which uses the more conventional rectangular cells. In the simulation performed in the following Example, a simulator was used which had a grid which contained a layer whose permeability was 100 times greater than the pay zone with $P_w$ being evaluated at a point 2.5 feet from the well and normal to the fracture plane.

The goal of fracturing for sand control in accordance with the present invention is to distribute the pressure drawdown near the wellbore along the fracture, thereby reducing the near-wellbore pressure gradient (see FIG. 5). Estimating the required fracture length and proppant conductivity are vital to accomplish post frac sand free production in a particular well.

Figure 6:
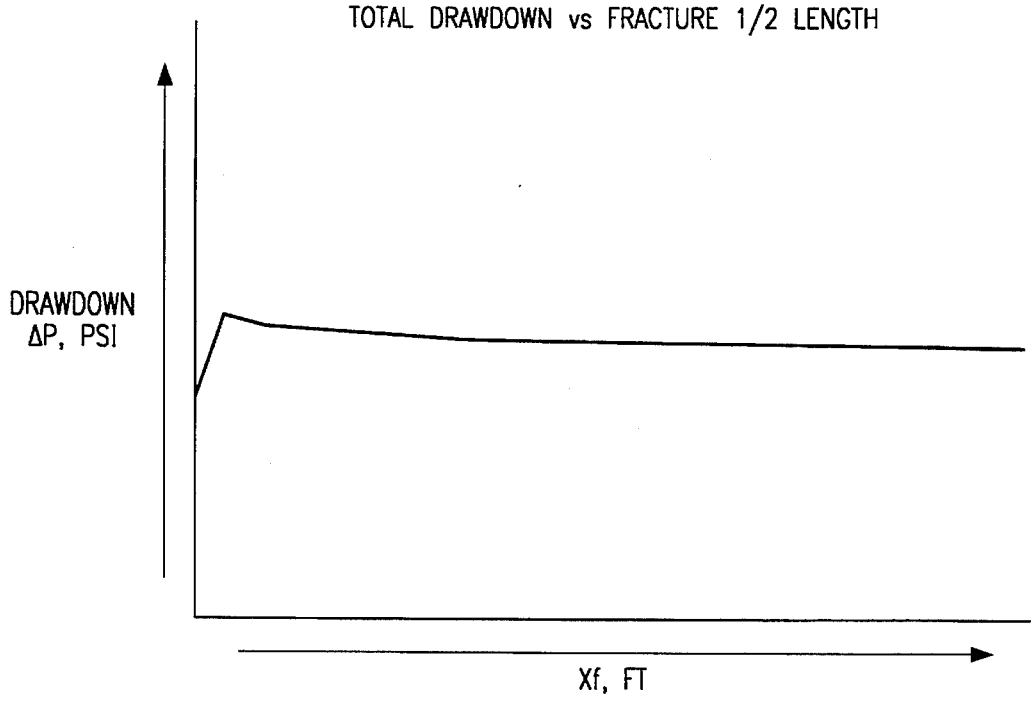
FIG. 6 is a graph plotting total drawdown pressure (TDP) versus fracture half-lengths.

Using the techniques and equations given above, the allowable TDP for perforation failure can be calculated. In summary, the effective drawdown across the perforation for various $X_f$'s are calculated based on the effect the fracture has on the near wellbore pressure distribution. Using this data, the TDP for a number of different $X_f$'s can then be calculated for a particular formation (see FIG. 6).

Once the TDP versus $X_f$ curve has been generated, a family of curves representing the pressure drop versus $X_f$ can be generated which apply to a given, constant production rate from that particular well. If there is a high degree of uncertainty of the post frac rate, a variety of cases can be run to estimate the optimum $X_f$ and conductivity. When overlaid with the TDP curve, the appropriate $X_f$ and conductivity for a given, desired constant rate can be estimated (see FIG. 7).

Figure 7:
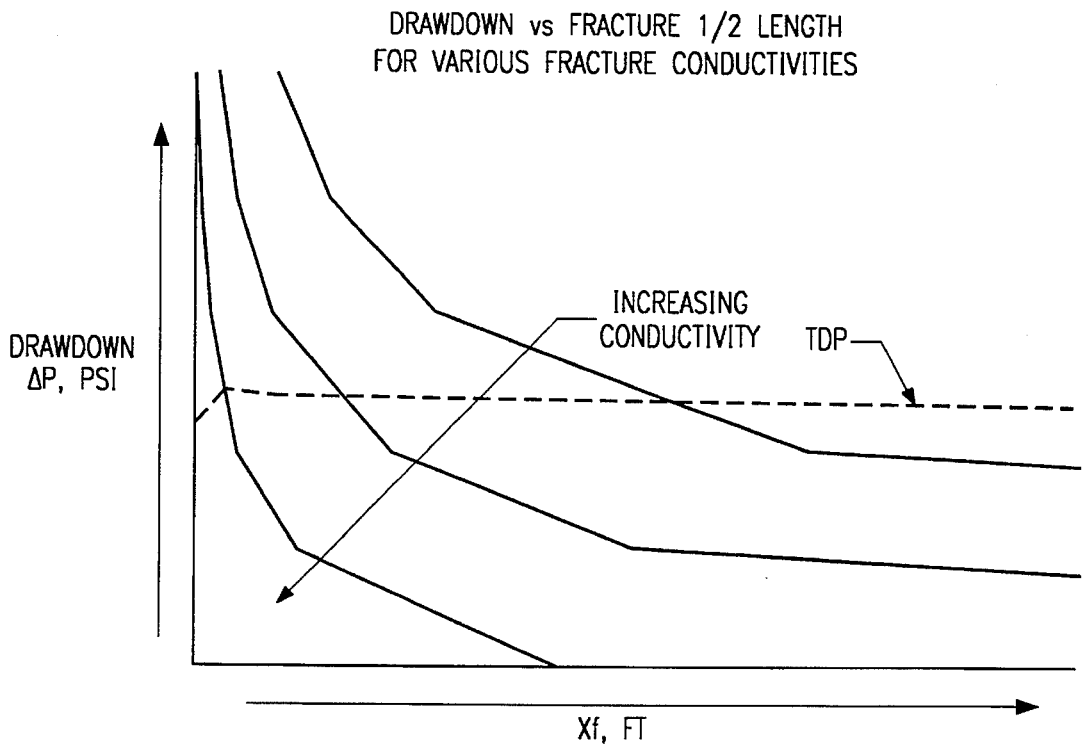
FIG. 7 is a graph plotting well drawdown pressures versus fracture half-lengths for various fracture conductivities while maintaining a constant production rate.

The conductivity of a fracture can be calculated from known relationships, see Recent Advances in Hydraulic Fracturing, Chapter 6, "Propping Agents and Fracture Conductivity", R.W. Anderson et al, SPE, Richardson, Tex., 1989 wherein:

$$k_f w = qmX_f/h\Delta p \quad (10)$$

where:

$k_f$=permeability of proppant w=propped width of fracture q=flow rate p=pressure h=height of fracture μ=viscosity Conductivities of fractures having various lengths can be calculated as shown in FIG. 7.

EXAMPLE

Figure 8:
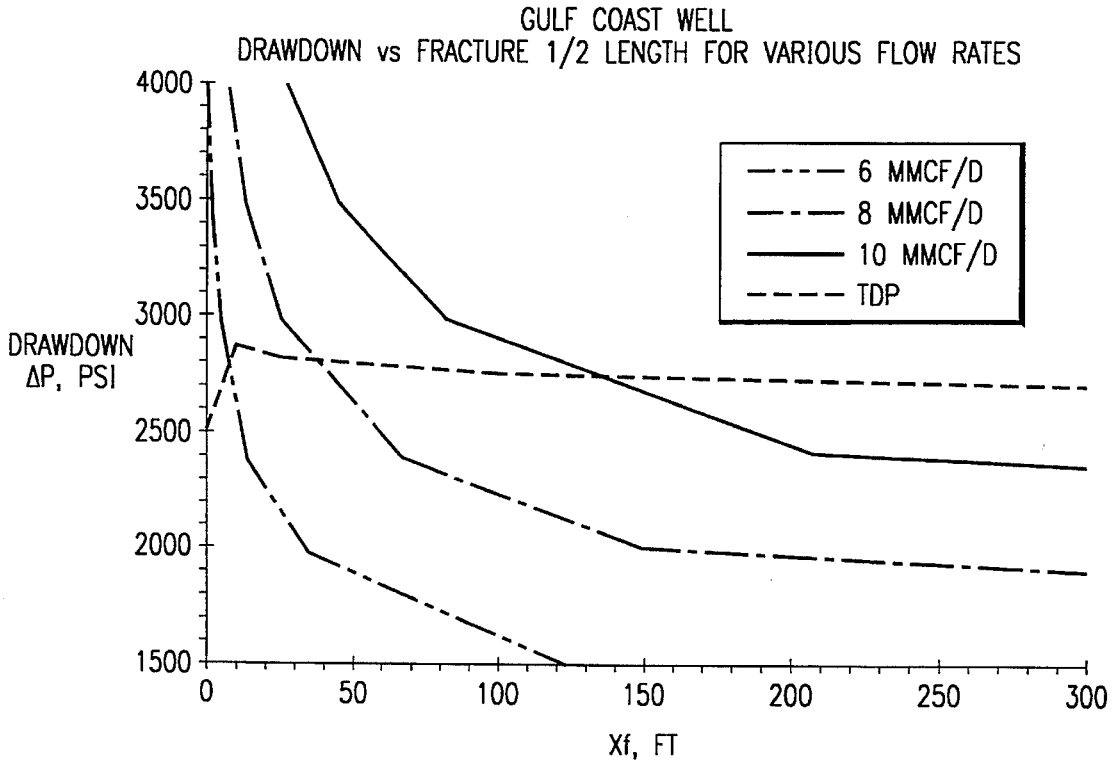
FIG. 8 is a graph plotting well drawdown pressures versus fracture half-lengths for an actual well.

The present invention was tested using data from a actual fracture-stimulation operation which had been performed on a well in the Gulf Coast of Mexico. The fracture-stimulation had been performed to overcome a formation damage problem that had left the well with a skin in excess of +40. The production formation was a thin sandstone with some degree of sand integrity. The porosity and permeability values of the formation were 17 per cent and 9 md, respectively. The stimulation operation placed 33,000 barrels of 20/40 low density, ceramic proppant into a fracture having a half-length ($X_f$) of approximately 180 feet. The post frac production rate and estimated fracture conductivity were 10 million cubic feet per day (10 MMCF/D) and 3000 md-ft, respectively. The actual drawdown versus $X_f$ curves for a variety of practical, commercial flowrates is shown in FIG. 8.

Figure 9:
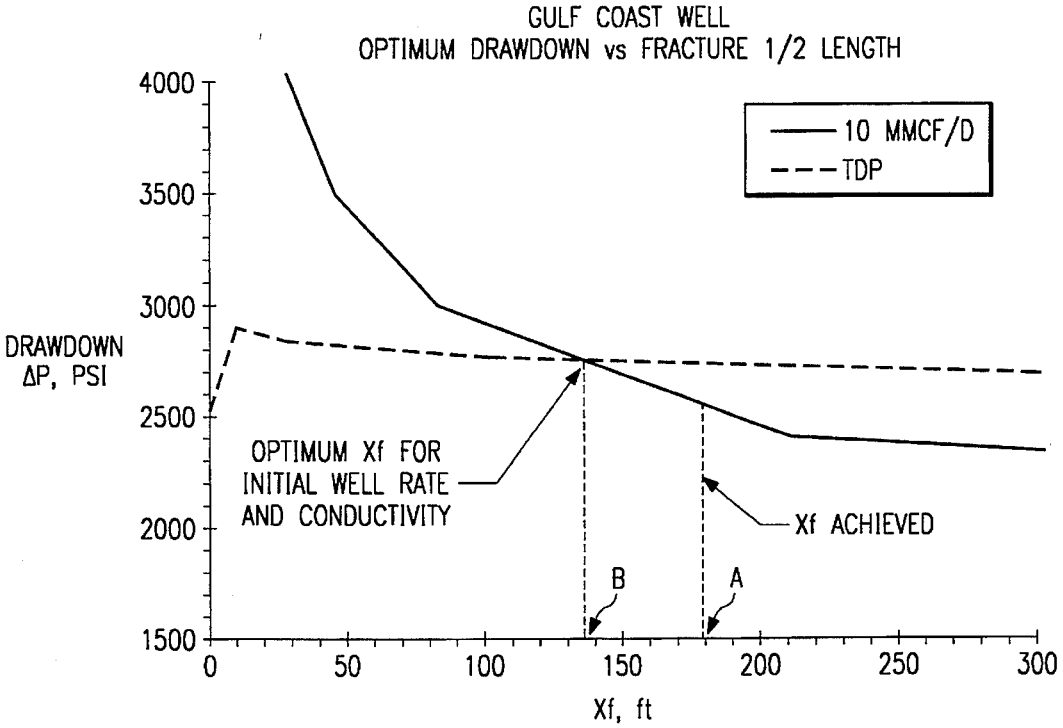
FIG. 9 is a graph plotting well drawdown pressures versus fracture half-lengths for an actual well comparing an optimum fracture half-length to the actual fracture half-length of the well.

The TDP curve was generated from available data and it was determined, in accordance with the present invention, that the length of the fracture that had actually been placed (point A on FIG. 9) was larger than was necessary for control of sand production under the existing conditions (point B on FIG. 9). That is, it was determined that to produce 10 MMCF/D below the total drawdown pressure of 2800 psi, a fracture half-length of only approximately 140 feet was needed, given a fracture conductivity of 3000 md-ft. However, for this particular well, additional stimulation was achieved due to the increase in the fracture length.

After over a year of sand-free production, the reservoir pressure declined by over 2000 psi. With this decline, the drawdown pressure had been slowly increased by the operator to maintain the desired, high production rate. Nevertheless, the well rate fell slowly from 10 MMCF/D to 7 MMCF/D with flowing bottom hole pressure (BHP) also declining. This decrease in BHP increased the confining pressure on the fracture by approximately 50 per cent. This increase in confining pressure on the proppant resulted in a decrease in the fracture conductivity of approximately one half of its original conductivity (see FIG. 10).

Figure 10:
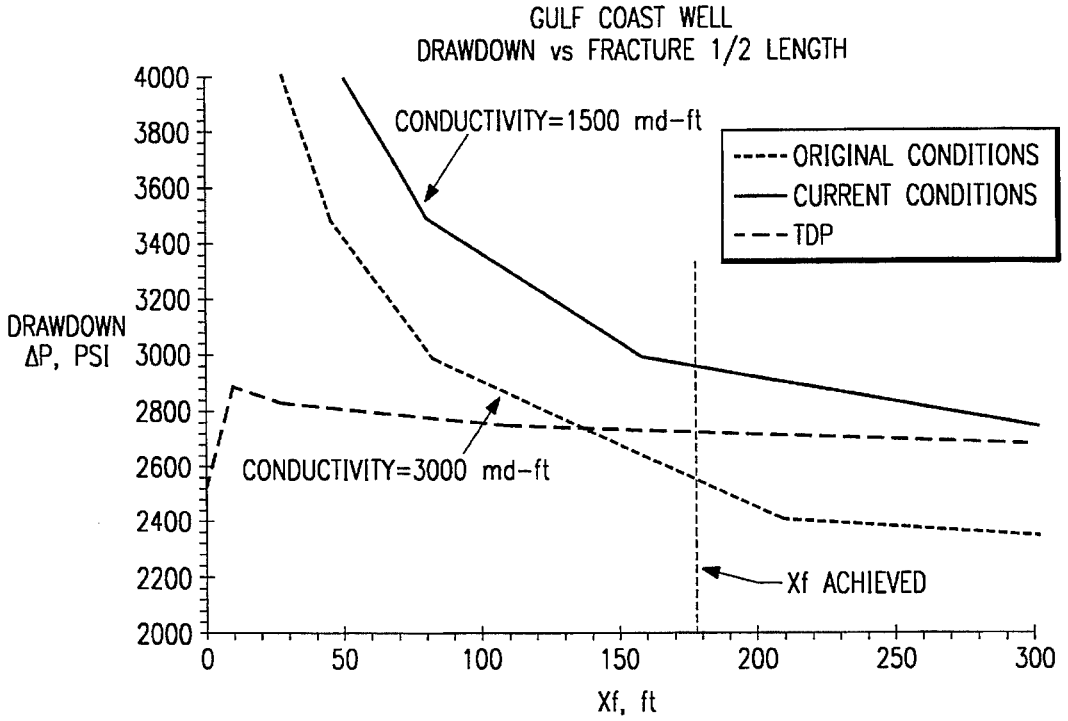
FIG. 10 is a graph plotting well drawdown pressures versus fracture half-lengths for an actual well showing conductivities as they declined during production.

Shortly after the drawdown pressure was increased above the critical drawdown pressure, the formation gave way and the well began to produce sand. The failure was primarily due to the excess drawdown pressure that was imposed in an unsuccessful attempt to maintain the original production rate. However, as shown in FIG. 10, due to the decreasing, low conductivity of the fracture, no fracture half-length would have been long enough to safely produce the well at 7 MMCF/D for any sustained period even at a 2800 psi drawdown.

The only alternative for this well would have been to lower the production rate with time as the conductivity declined. FIG. 10 clearly illustrates the importance of planning for future conditions when designing a fracture stimulation for sand control. If high enough conductivities can be achieved during the fracture (wide enough fractures and/or large enough proppant), a well's production rate can be optimized for sand-free production solely based on drawdown pressure at which the well is to be operated.

What is claimed is:

1. A method for determining the minimum length for a fracture in a fluid-producing formation to control the production of sand therefrom; said method comprising:

measuring the strength of said formation and the fluid properties of the formation fluids;

calculating a plurality of critical drawdown pressures, based on said measured strength and fluid properties which occur at a plurality of different fracture lengths, respectively, in said formation;

selecting a desired, constant flowrate for producing said fluids from said formation;

calculating the respective production drawdown pressures necessary for producing said fluids from said formation at said desired, constant flowrate for a plurality of different respective fracture conductivities and fracture lengths; and comparing said plurality of critical drawdown pressures with the plurality of said respective production drawdown pressures to thereby determine the length of fracture from those used to calculate said critical drawdown pressures and said production drawdown pressures below which said formation can be produced at said desired, constant flowrate without producing sand from the formation.

2. The method of claim 1 wherein said critical drawdown pressures (CDP) are calculated in accordance with the following relationship:

$TDP=dP_w=\Delta p(X_f)$ where $\Delta p(X_f)=P_{inf}-Pw(X_f)$ wherein $P_{inf}$=far-field formation pressure at infinity $p_w(X_f)$=near-well pressure with fracture.

3. The method of claim 1 wherein said different critical drawdown pressures (CDP) are calculated by varying the gas density (m) exponent for said formation fluids to those corresponding to the gas density at said different fracture lengths, respectively, in the following relationship:

$$\frac{4\sin\alpha}{1-\sin\alpha}-\left(\frac{P'_w-P'_a}{m+1}\right)\left(p'^{\left(\frac{-m}{m+1}\right)}_w\right)=0$$

where $$P'_a=\left[\frac{p_a\tan\alpha}{C}\right]^{(m+1)}$$

$$P'_w=\left[\frac{p_w\tan\alpha}{C}\right]^{(m+1)}$$

wherein:

$\alpha$=angle of internal friction $P_a$=wellbore pressure $P_w$=pore pressure at perforation C=initial shear or cohesive strength.

4. The method of claim 1 wherein C and $\alpha$ are measured from a core sample taken from said reservoir.

5. The method of claim 1 wherein C and $\alpha$ are measured from wellbore logs.

6. A method for determining the minimum length for a fracture in a fluid-producing formation to control the production of sand therefrom; said method comprising:

measuring the strength of said formation and the fluid properties of the formation fluids;

calculating a plurality of critical drawdown pressures, based on said measured strength and fluid properties which occur at a plurality of different fracture lengths, respectively, in said formation;

selecting a constant flowrate for producing said fluids from said formation;

calculating the respective fracture conductivities necessary for producing said fluid from said formation at said constant flowrate for a plurality of different drawdown pressures and fracture lengths, and comparing said plurality of critical drawdown pressures with the plurality of said respective fracture conductivities to thereby determine the length of fracture from those used to calculate said critical drawdown pressures and said fracture conductivities below which said formation can be produced at said constant flowrate without producing sand from the formation.

7. A method for determining the minimum length for a fracture in a fluid-producing formation to control the production of sand therefrom; said method comprising:

measuring the strength of said formation and the fluid properties of the formation fluids;

calculating a plurality of critical drawdown pressures, based on said measured strength and fluid properties which occur at a plurality of different fracture lengths, respectively, in said formation;

selecting a constant fracture conductivity;

calculating the respective flowrates necessary for producing said fluid from said formation at said constant fracture conductivity for a plurality of different drawdown pressures and fracture lengths; and comparing said plurality of critical drawdown pressures with the plurality of said respective flowrates to thereby determine the length of fracture from those used to calculate said critical drawdown pressure and said fracture conductivities below which said formation can be produced at said constant fracture conductivity without producing sand from the formation.

* * * * *